US006082225A

United States Patent [19]

Richardson

[11] Patent Number: 6,082,225

[45] Date of Patent: Jul. 4, 2000

[54] POWER TONG WRENCH

[75] Inventor: Allan S. Richardson, Calgary, Canada

[73] Assignee: Canrig Drilling Technology, Ltd., Houston, Tex.

[21] Appl. No.: 08/802,783

[22] Filed: Feb. 18, 1997

Related U.S. Application Data

[63] Continuation of application No. 08/510,362, Aug. 2, 1995, abandoned, which is a continuation-in-part of application No. 08/189,356, Jan. 31, 1994, abandoned.

[51] Int. Cl.[7] ..... B25B 17/00

[52] U.S. Cl. ..... 81/57.16; 81/57.19; 81/57.34

[58] Field of Search ..... 81/57.15, 57.16, 81/57.19, 57.21, 57.34

[56] References Cited

U.S. PATENT DOCUMENTS 4,649,777 3/1987 Buck .
4,696,206 9/1987 Renfro .
4,791,838 12/1988 Bickford et al. .
4,811,635 3/1989 Falgout .
4,979,356 12/1990 Vatne .
5,159,860 11/1992 Pietras .
5,161,438 11/1992 Pietras .
5,167,173 12/1992 Pietras .

FOREIGN PATENT DOCUMENTS 2079817 1/1982 United Kingdom .

*Primary Examiner*—James G. Smith
*Attorney, Agent, or Firm*—Baker Botts L.L.P.

[57] ABSTRACT

A power tong wrench having an open slot to accommodate a range of pipe diameters capable of making and breaking pipe threads and spinning in or out the threads and in which hydraulic power is supplied with a pump disposed within a rotary assembly, which pump is powered through a non-mechanical coupling, preferably magnetic, to a motor disposed outside the rotary assembly.

21 Claims, 5 Drawing Sheets

FIG.6A
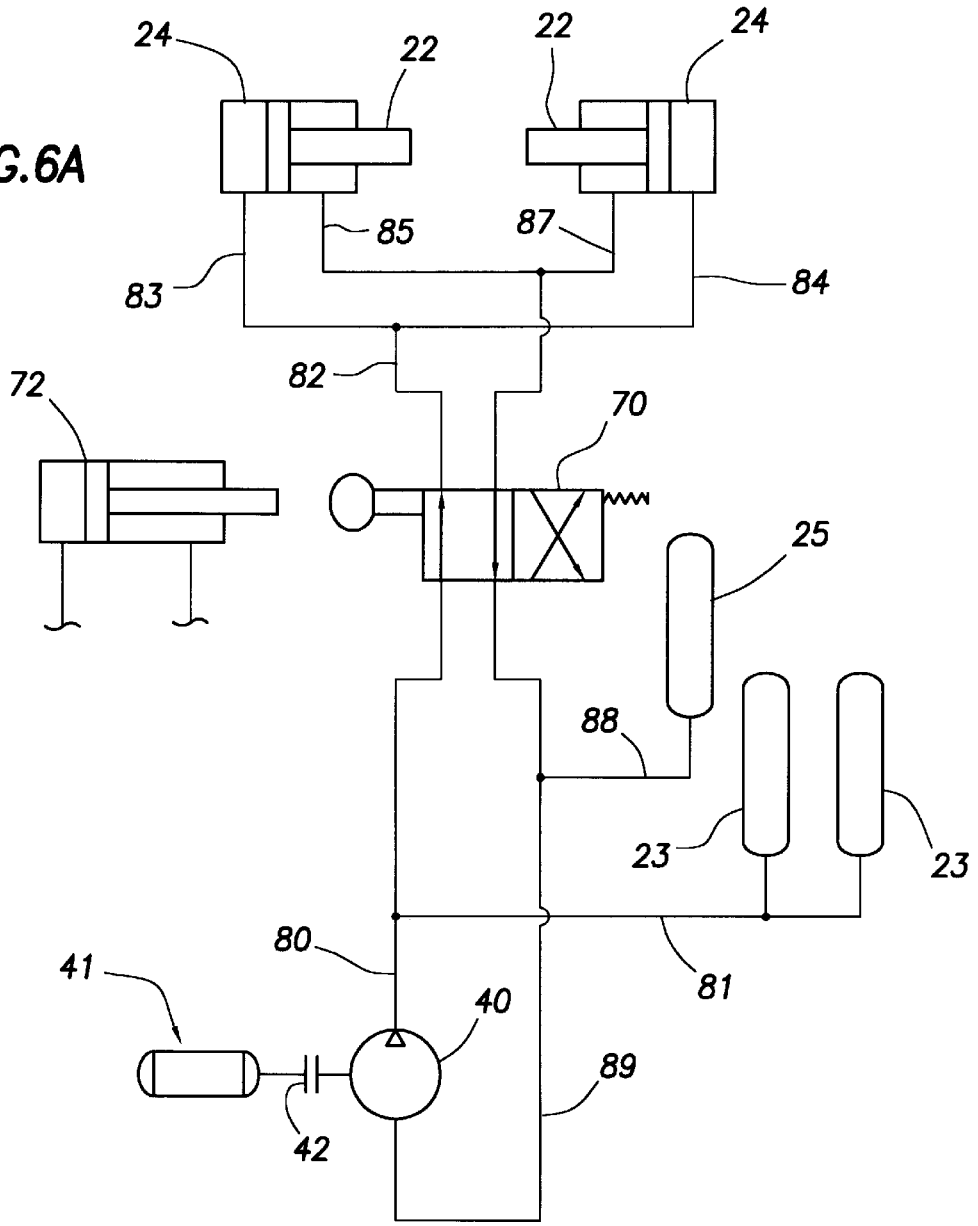
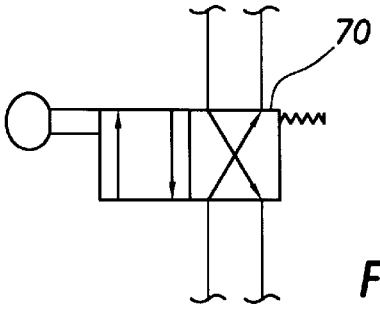
FIG.6B

POWER TONG WRENCH

This is a continuation of application Ser. No. 08/510,362, filed Aug. 2, 1995 now abandoned, which is a continuation-in-part of application Ser. No. 08/189,356, filed Jan. 31, 1994, now abandoned.

BACKGROUND OF THE INVENTION

This invention relates to a power wrench and wrench assembly for making and breaking threads in sections of pipe and pipe couplings.

In oil and gas well drilling operations, the drill pipe is assembled in lengths joined with threaded joints. As the pipe is fed into a well, the sections of pipe are threaded together through couplings. When removing pipe, the threaded sections must be disconnected and the sections of pipe stored. Inserting and removing the sections of drill pipe is called "tripping." It will be appreciated that threading and unthreading sections of pipe on tripping in and out of the well hole can be a difficult and cumbersome job. To make up the threads (or unscrew or break the threads) requires relatively high torque (rotational force). "Spinning" the pipe section after breaking (or before making up) the joints requires much less torque and is accomplished at much higher speed. Tightening and breaking joints requires the wrench to be tightly clamped on the pipe. In the early days, tightening and breaking was done manually with hand wrenches (more recently with power assisted wrenches). Spinning is a separate operation, done by wrapping a chain around the pipe and pulling the chain with a winch. Today power tong wrenches are used. These ("roughnecks") have an open slot for pipe insertion and hydraulically powered clamps to grip the pipe. The wrench is rotated by a motor mechanically attached to the wrench. Mechanical attachment of the turning mechanism limits the turn of such wrenches to about 45°. Such wrenches can develop high torque and work very well for making and breaking thread joints. It will be appreciated that these wrenches work in combination with a backup wrench that holds fast the other section of threaded joint. The wrench must be removed after making or breaking the threads, and a spinner (or top drive unit) attached to spin out the threaded joint. Such wrenches are exemplified by the description in U.S. Pat. No. 4,348,920. Some types of these wrenches lack the capacity of handling different diameter pipe without changing pipe clamps. Since drill pipe, couplings, tapered pipe and joints are of different diameters, a successful wrench must handle widely varying diameters—from about 3.5 to about 9.5 inches in diameter. It is a great advantage for a wrench to be able to accommodate a range of diameters without having to change the clamps. U.S. Pat. No. 4,979,356 is an example. of a solution to this problem. It describes a power tong wrench which can not only accommodate the desired range of pipe diameters but is also capable of making and breaking pipe sections and spinning the pipe. The ability to do both with the same wrench is highly desirable since it accomplishes with one connection step what previously required two or more connections with a wrench and spinner. The U.S. Pat. No. 4,979,356 wrench comprises an inner immediate and outer annuli which consists of halves that can be split to mount around the pipe. Gripping is accomplished by clamps; hydraulically driven by an actuator which has a reach sufficient to accommodate various pipe diameters. The difficulty with this wrench is that it must be manually clamped around the pipe and manually disconnected. It lacks the open slot pipe entrance of the "roughneck."

It would be very desirable to have a power tong unit that can accommodate various pipe diameters and that has the making, breaking and spinning capability of the U.S. Pat. No. 4,979,356 power tong and the ease of assembly of the slotted roughneck wrench. This is difficult to accomplish because of the mechanical connection of the clamp actuators and rotating assemblies.

SUMMARY OF THE INVENTION

I have developed a power tong wrench which accomplishes this combination of features. It provides a slotted opening to accommodate various pipe diameters (e.g., 3.5 to 9.5 inches), can develop high torque for making and breaking, and can spin at high speed. This is accomplished by providing a releasable coupling of a drive motor mounted in a wrench housing to a hydraulic pump mounted in a spinning unit. The hydraulic pump pressures hydraulic accumulators located in the rotary unit. The accumulators provide hydraulic fluid to actuators for the pipe clamps located in the rotary unit. By releasably coupling the motor to the pump any limitation on rotation is eliminated. It is preferred that the coupling be magnetic. In one aspect, the invention relates to a power tong wrench comprising a rotary jaw frame having a cut-out formed therein for receiving an object, a rotatable assembly rotatably mounted in the rotary jaw frame, the rotatable assembly comprising a rotary jaw clamp adapted to clamp the object and an energy storage device arranged to selectively apply energy to the rotary jaw clamp; and an energy source mounted on the rotary jaw frame to supply energy to the energy storage device.

In another aspect, the invention relates to a power tong assembly comprising a power tong wrench including a rotary jaw frame having a cut-out formed therein for receiving an object; a rotatable assembly rotatably mounted in the rotary jaw frame, the rotatably assembly comprising a rotary jaw clamp adapted to clamp the object and an energy storage device arranged to selectively apply energy to the rotary jaw clamp; and an energy source mounted on the rotary jaw frame to supply energy to the energy storage device. The assembly further comprises a back-up wrench, including a back-up jaw frame arranged to support the rotary jaw frame, and a back-up clamp fixedly mounted to the backup jaw frame.

In another aspect, the invention relates to a method of actuating a rotary jaw clamp of a power tong wrench having a rotatable assembly on which the rotary jaw clamp, a hydraulic accumulator, and a hydraulic reservoir are mounted, comprising the steps of: charging the hydraulic accumulator; closing the rotary jaw clamp by applying hydraulic pressure from the hydraulic accumulator to the rotary jaw clamp; and opening the rotary jaw clamp by releasing hydraulic pressure from the rotary jaw clamp to the reservoir.

BRIEF DESCRIPTION OF THE DRAWINGS

FIGS. 6A and 6B are schematic representations of a portion of a control panel illustrating operation of a wrench of the invention.

DESCRIPTION OF THE PREFERRED EMBODIMENTS

Figure 5:
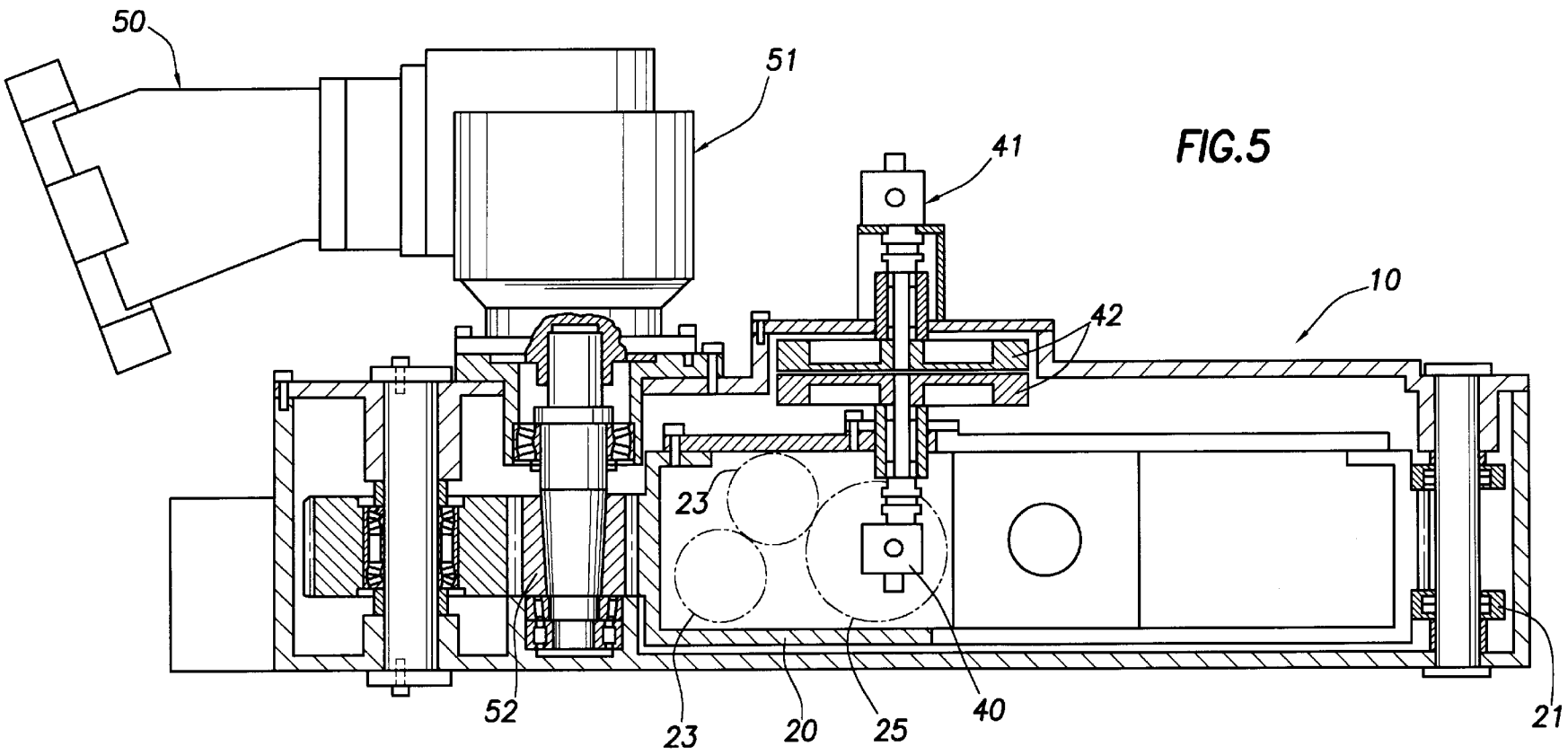
FIG. 5 is a cross-sectional view of the wrench of FIG. 4 showing the drive motor, planetary reducers and hydraulic motor and pump.

A unique advantage of this invention is achieved by providing for hydraulic power to operate pipe clamps "on board" a rotary assembly. This is achieved by providing a hydraulic pump (40 in FIGS. 5 and 6A) and accumulators (23 and 25) to ride on the rotary assembly. Hydraulic power is provided to the accumulators (pressured against gas pressure) by operation of a hydraulic fluid pump through a magnetic coupling (42) of the motor (41). The magnetic coupling allows transmission of rotary power to the pump without the need for a fixed attachment of the pump to the motor. This overcomes the limitation on rotation of the rotary assembly that characterizes the power tongs of the prior art. The prior art overcomes this limitation through special clamps and latches. Such clamps and latches impede the automated operation that is possible with the present invention.

Figure 1:
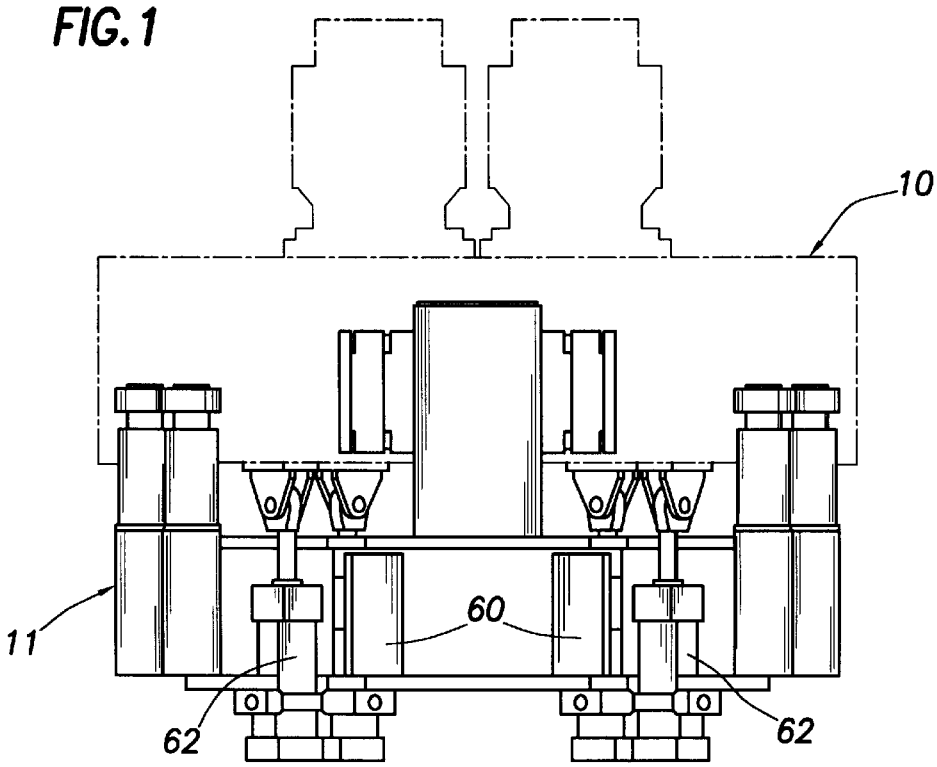
FIG. 1 is a side view of a power tong according the one embodiment showing details of the backup wrench.
Figure 2:
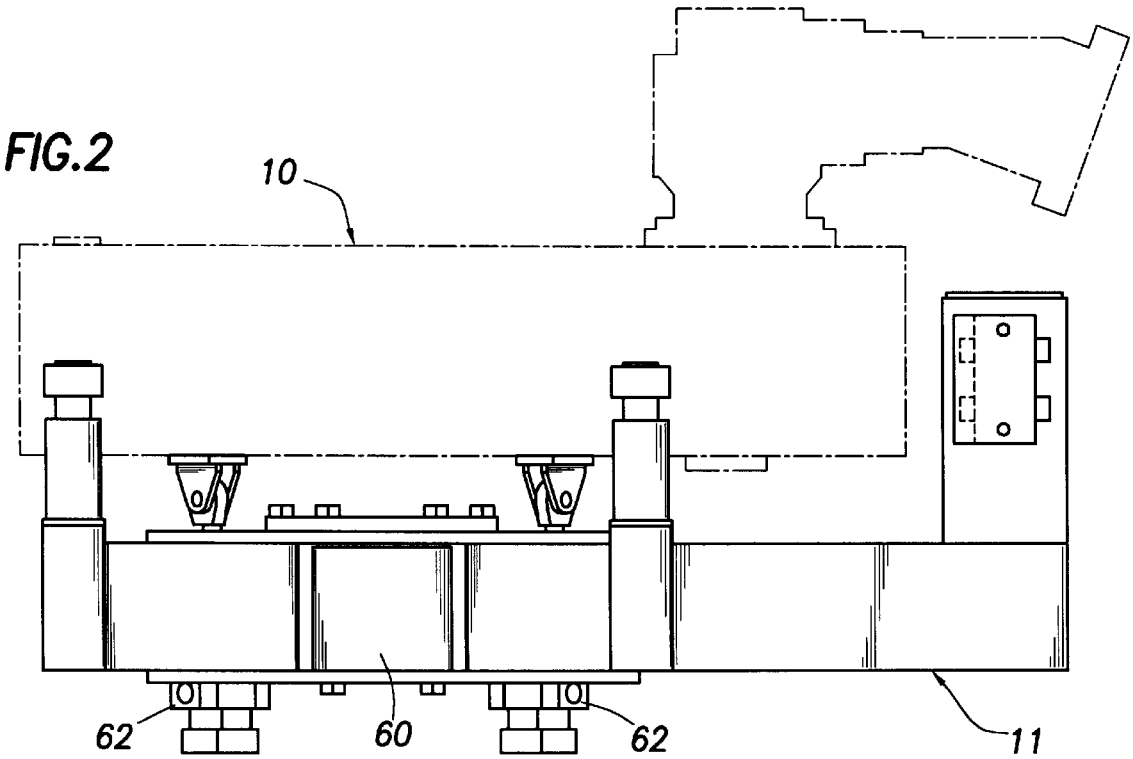
FIGS. 2 and 3 are end and top views, respectively, of the power tong assembly of FIG. 1.

In one embodiment, the invention is a power tong wrench assembly comprising the following components as illustrated in the Figures:

1. A rotary jaw frame (10) and a backup jaw frame (11) (FIGS. 1 and 2).

Figure 4:
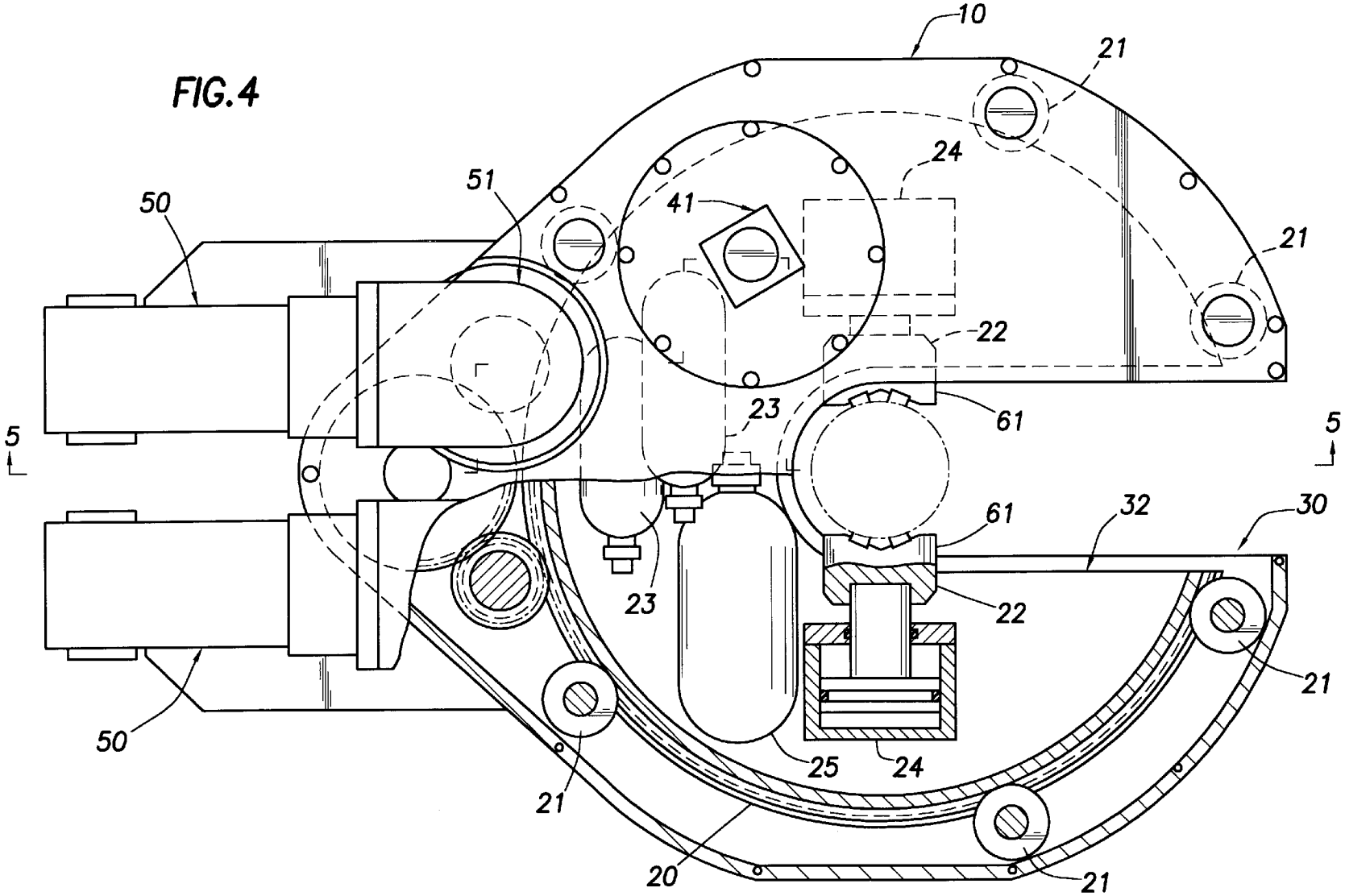
FIG. 4 is a top view of a power tong wrench according to one embodiment.

2. Within the rotary jaw frame (10), a bull gear (20 in FIGS. 4 and 5) with a cut-out (32) on one side to allow it to be positioned around pipe such as a drill string when aligned as shown in FIG. 4 with a corresponding cut-out (30) in the rotary jaw frame (10).

3. A series of rollers (21 in FIGS. 4 and 5) mounted around the circumference of the bull gear (20) to support it, laterally locate it and allow it to rotate. These rollers are mounted in the rotary jaw frame (10).

4. opposing rotary clamp jaws (22 in FIG. 4) driven by hydraulic cylinders (24) mounted within the bull gear (20) and forming a rotary jaw clamp.

5. A hydraulic actuation assembly for the rotary jaw clamp (22) including:

a. a small hydraulic pump (40) (rotary clamp pump) and oil reservoir within the bull gear (20);

b. a stationary hydraulic motor (41) mounted on the rotary jaw frame (10) which powers the rotary clamp pump (40);

c. a magnetic, no-contact drive coupling (42) which transmits low level rotary power from the motor (41) on the rotary jaw frame to the pump (40) on the bull gear. Opposing coupling halves of the releasable coupling preferably include a series of magnets arranged in a circle with alternating polarity. The coupling halves are aligned only when the bull gear is in its "home" position (with the cut-out section (32) aligned with cut-out (30) in the rotary jaw frame to receive pipe). The rotary clamp pump is therefore driven only by the motor through the magnetic coupling when the bull gear (20) is in the "home" position.

d. hydraulic accumulators (23) (preferably nitrogen charged) that store hydraulic energy from the rotary clamp pump for use when the bull gear (20) is not in the "home" position, mounted within the bull gear; and e. a hydraulic valve (70) to open or close the rotary jaw clamp and a means (72) to actuate this valve when the rotary clamp is in any position.

6. One or more drive motors (50), preferably hydraulic, and planetary gear reducers (51) mounted on the rotary jaw frame and connected to pinions (52) that drive the bull gear. It is preferred (but not necessary) that variable displacement hydraulic motors be used to avoid the need for a mechanical gear shift to enable both high-torque/low-speed (for making and breaking) and low-torque/high-speed (spinning) operations. Mechanical shifting requirements slow down the operation of the tongs.

Figure 3:
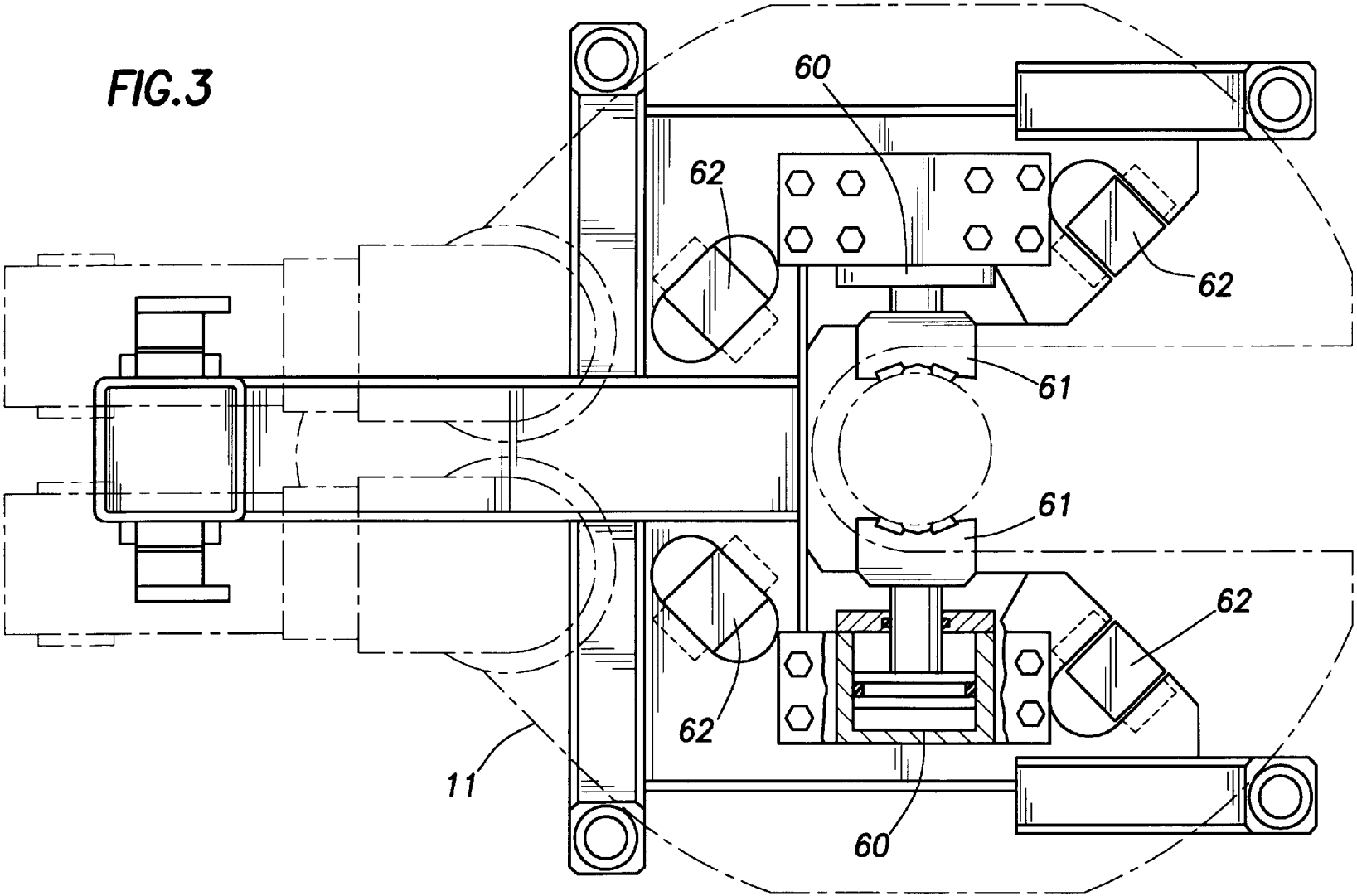

In one embodiment, the invention is an assembly which comprises the above elements 1–6 plus the additional elements as follows:

7. Backup clamp actuators (60 in FIG. 3) rigidly mounted in the backup jaw frame (11) which actuate opposing hydraulic cylinder clamp jaws (61).

8. Mounting means whereby the rotary jaw frame (10) is supported on the backup jaw frame (11) on four (4) cylinders (62) (vertical float cylinders) that have the following characteristics:

a. the rotary jaw frame (10) is allowed to float axially a few inches on the vertical float cylinders (62) to allow for thread advance; and b. the rotary jaw frame (10) is torsionally free of the backup jaw frame (11) and the torque reaction is taken by a load cell for torque instrumentation. This torsional freedom of the mounting is accomplished by allowing the vertical float cylinders to pivot about a trunnion axis which is on a radius from the tong centerline.

9. Suitable mounting assemblies for the backup jaw frame (11). Mounting in a drilling rig can be effected in a number of ways, such as free hanging, frame mounted with vertical and lateral positioning or floor track mounted.

10. A hydraulic power unit for supply to hydraulic functions.

11. Hydraulic valves for control (as shown schematically in FIGS. 6A and 6B of all functions including the rotary clamp, the back-up clamp (60), forward/reverse rotation, vertical positioning, fore/aft positioning and vertical float.

12. A control console with electric over hydraulic for all functions and with torque instrumentation is illustrated schematically in FIGS. 6A and 6B.

Operation of the power tong assembly in a drilling operation is as follows:

1. The power tong assembly normally rests in the "home" position with the open side of the bull gear (20) to the front for access of the drill pipe. In this position, the magnetic coupling (42) is aligned and the rotary clamp pump (40) is driven to charge the accumulator 23.

2. When the power tong assembly is needed, it is positioned around the pipe of the drill string and elevated to the correct position with the rotary jaw clamp on one side of a threaded joint and the back-up clamp on the other.

3. The backup clamp is closed by pressuring the hydraulic cylinders (60).

4. The rotary jaw clamp is closed by actuating a rotary clamp valve (70) or mechanism (72) which shifts the valve (70) and allows hydraulic fluid to flow from the accumulators (23) to the hydraulic cylinders (24).

5. The drive motors (50) are actuated to rotate the rotary jaw clamp to break the connection and subsequently spin it out.

6. The rotary jaw clamp is opened by actuating the rotary clamp valve mechanism (70) which shifts the valve and allows hydraulic fluid to flow from the hydraulic cylinders (24) to the reservoir (25) in the bull gear (20). This can be better illustrated by referring to FIGS. 6A and 6B. To close the clamps, fluid is allowed to flow from the pump (40) through lines 83 and 84 to the outside compartments of actuator cylinders (60). This forces the clamp actuators to move the clamps toward the pipe. To open the clamps, the valve 70 is moved to the position shown in FIG. 6A. This allows the fluid to flow through lines 85 and 86 moving the clamps away from the pipe face. Since this clamping and unclamping can be accomplished completely by means "on board" the rotary assembly, the rotary assembly can rotate freely.

7. The drive motors (50) are used to return the bull gear (20) to its "home" position (the position shown in FIG. 4). This allows the power tong to be removed from the drill string and allows resumption of driving the rotary clamp pump 40 to charge the accumulators (23) in preparation for the next usage.

8. The backup clamp (60) is opened and the tong is repositioned into its parking position, e.g., the desired position when not in use.

This power tong assembly has a number of advantages over other presently available systems, including the following:

1. It can accommodate a wide variation of pipe diameters without clamp changes since the gripping elements of both the power tong wrench and the backup wrench are hydraulically actuated.

2. Use of the hydraulic motor drive allows make-up or break out of threads at low speed (high torque) and subsequent spinning at lower torque and high speed without changing or shifting gears. A prototype unit, as illustrated at FIGS. 1–5, is designed to develop 100,000 foot pounds of torque (useful to breakout a 9 inch diameter collar) at low speed, but 40–50 RPM at low torque, as for spinning. The lack of shifting allows smoother and safer operation than mechanical shifting.

3. The power tong assembly of this invention provides simple operation since it functions as both wrench and spinner, has no gates or latches that must be installed around or on the pipe and has an open pipe mouth to accommodate a range of pipe diameters, making it possible to mount the unit in a number of ways convenient for use on the drilling rig. The entire unit can be operated from a single control panel.

Another feature and advantage of this invention is the ability to adjust the spacing of the backup wrench assembly and the power tong wrench using the vertical float cylinders (62) as illustrated. This allows for the necessary adjustment of spacing as the thread advances when making up a section of pipe. It allows smooth operation without the need to stop and make adjustments to the connection between the power tong and backup wrench.

All the features of this invention are made to allow remote operation of the complete assembly without the need to manually connect or disconnect any individual components. Thus, the assembly can be automated to operate with a minimum of labor and expense and without endangering operators.

Other means of accomplishing the functions explained above are within the scope of this description, and the following claim and other advantages will be apparent to those skilled in this art.

What is claimed is:

1. A power tong wrench, comprising:

a rotary jaw frame having a cut-out formed therein for receiving an object;

a rotatable assembly rotatably mounted in said rotary jaw frame, said rotatable assembly comprising a rotary jaw clamp adapted to clamp the object and an energy storage device arranged to selectively apply energy to said rotary jaw clamp;

an energy source mounted on said rotary jaw frame to supply energy; and a magnetic coupling for coupling the energy source to said energy storage device.

2. The power tong wrench of claim 1, further comprising at least one drive motor for rotating said rotatable assembly relative to said rotary jaw frame.

3. The power tong wrench of claim 2, wherein said drive motor is hydraulic.

4. The power tong wrench of claim 1, wherein said rotatable assembly comprises a bull gear rotatably mounted in said rotary jaw frame by a plurality of rollers.

5. The power tong wrench of claim 1, wherein said energy source supplies energy to said energy storage device via the magnetic coupling when a cut-out in said rotatable assembly is aligned with said cut-out in said rotary jaw frame.

6. The power tong wrench of claim 1, wherein said energy storage device comprises a hydraulic accumulator, and said rotary jaw clamp comprises a plurality of jaws driven by hydraulic cylinders.

7. The power tong wrench of claim 6, further comprising a hydraulic pump mounted on said rotatable assembly to charge said hydraulic accumulator.

8. The power tong wrench of claim 7, wherein said energy source comprises a coupling motor arranged to drive said hydraulic pump via the magnetic coupling when a cut-out in said rotatable assembly is aligned with aid cut-out in said rotary jaw frame.

9. The power tong wrench of claim 6, further comprising a valve and a reservoir mounted on said rotatable assembly, said valve having a first position in which hydraulic fluid is supplied from said hydraulic accumulator to said hydraulic cylinders, and a second position in which hydraulic fluid is released from said hydraulic cylinders to said reservoir.

10. A power tong assembly, comprising:

a power tong wrench, comprising:

a rotary jaw frame having a cut-out formed therein for receiving an object;

a rotatable assembly rotatably mounted in said rotary jaw frame, said rotatable assembly comprising a rotary jaw clamp adapted to clamp the object and an energy storage device arranged to selectively apply energy to said rotary jaw clamp, and an energy source mounted on said rotary jaw frame to supply energy;

a magnetic coupling for coupling the energy source to said energy storage device; and a back-up wrench, comprising:

a back-up jaw frame arranged to support said rotary jaw frame, and a back-up clamp fixedly mounted to said back-up jaw frame.

11. The power tong assembly of claim 10, wherein said rotary jaw frame is supported on said back-up jaw frame by a plurality of cylinders, and the cylinders providing a limited degree of axial and torsional freedom.

12. The power tong assembly of claim 11, wherein said cylinders are mounted to pivot about a trunnion axis that is on a radius from a centerline of the rotary jaw clamp and the back-up clamp.

13. The power tong assembly of claim 10, wherein said back-up clamp comprises a plurality of jaws driven by hydraulic cylinders.

14. The power tong wrench of claim 10, further comprising at least one drive motor for rotating said rotatable assembly relative to said rotary jaw frame.

15. The power tong wrench of claim 14, wherein said drive motor is hydraulic.

16. The power tong wrench of claim 10, wherein said rotatable assembly comprises a bull gear rotatably mounted in said rotary jaw frame by a plurality of rollers.

17. The power tong wrench of claim 10, wherein said energy source supplies energy to said energy storage device via a releasable coupling when a cut-out in said rotatable assembly is aligned with said cut-out in said rotary jaw frame.

18. The power tong wrench of claim 10, wherein said energy storage device comprises a hydraulic accumulator, and said rotary jaw clamp comprises a plurality of jaws driven by hydraulic cylinders.

19. The power tong wrench of claim 18, further comprising a hydraulic pump mounted on said rotatable assembly to charge said hydraulic accumulator.

20. The power tong wrench of claim 19, wherein said energy source comprises a coupling motor arranged to drive said hydraulic pump via the magnetic coupling when a cut-out in said rotatable assembly is aligned with said cut-out in said rotary jaw frame.

21. The power tong wrench of claim 18, further comprising a valve and a reservoir mounted on said rotatable assembly, said valve having a first position in which hydraulic fluid is supplied from said hydraulic accumulator to said hydraulic cylinders, and a second position in which hydraulic fluid is released from said hydraulic cylinders to said reservoir.

* * * * *